United States Patent [19]

Hanlon

[11] Patent Number: 4,482,353

[45] Date of Patent: Nov. 13, 1984

[54] COMPRESSION IGNITION FUEL COMPOSITIONS

[75] Inventor: J. Vincent Hanlon, Baton Rouge, La.

[73] Assignee: Ethyl Corporation, Richmond, Va.

[21] Appl. No.: 520,156

[22] Filed: Aug. 4, 1983

[51] Int. Cl.[3] ..... C10L 1/22

[52] U.S. Cl. ..... 44/57; 44/62; 44/72; 123/1 A

[58] Field of Search ..... 44/57, 62, 72

[56] References Cited

U.S. PATENT DOCUMENTS

| | | | |
|---|---|---|---|
| 3,413,104 | 11/1968 | Mehmedbasich | 44/62 |
| 3,909,215 | 9/1975 | Kray | 44/62 |
| 4,163,645 | 8/1979 | Cheng et al. | 44/62 |
| 4,208,190 | 6/1980 | Malec | 44/57 |

*Primary Examiner*—Mrs. Y. Harris-Smith

*Attorney, Agent, or Firm*—Donald L. Johnson; John F. Sieberth; Willard G. Montgomery

[57] ABSTRACT

Coking in and around the injector nozzle of indirect injection compression ignition engines is reduced by means of distillate fuel with which has been blended suitable concentrations of (a) organic nitrate ignition accelerator, (b) copolymer of an alpha-olefin having from 8 to 30 carbon and an N-substituted maleimide wherein the N-substituents are organic radicals having from 3 to 60 carbons and from 1 to 5 amine nitrogens, said copolymer having from 4 to 20 repeating olefin-maleimide units, and (c) hydrocarbyl amine having from 3 to 60 carbons and from 1 to 10 nitrogens.

20 Claims, 1 Drawing Figure

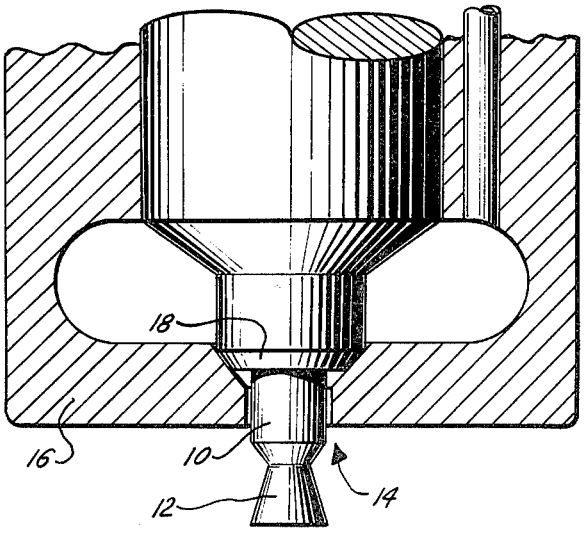
18
16
10
12
14

COMPRESSION IGNITION FUEL COMPOSITIONS

FIELD

This invention relates to compression ignition fuel compositions of enhanced resistance to coking tendencies when employed in the operation of indirect injection diesel engines.

BACKGROUND

Throttling diesel nozzles have recently come into widespread use in indirect injection automotive and light-duty diesel truck engines, i.e., compression ignition engines in which the fuel is injected into and ignited in a prechamber or swirl chamber. In this way, the flame front proceeds from the prechamber into the larger compression chamber where the combustion is completed. Engines designed in this manner allow for quieter and smoother operation. The Figure of the Drawing illustrates the geometry of the typical throttling diesel nozzle (often referred to as the "pintle nozzle").

Unfortunately, the advent of such engines has given rise to a new problem, that of excessive coking on the critical surfaces of the injectors that inject fuel into the prechamber or swirl chamber of the engine. In particular and with reference to the FIGURE, the carbon tends to fill in all of the available corners and surfaces of the obturator 10 and the form 12 until a smooth profile is achieved. The carbon also tends to block the drilled orifice 14 in the injector body 16 and fill up to the seat 18. In severe cases carbon builds up on the form 12 and the obturator 10 to such an extent that it interferes with the spray pattern of the fuel issuing from around the perimeter of orifice 14. Such carbon build up or coking often results in such undesirable consequences as delayed fuel injection, increased rate of fuel injection, increased rate of combustion chamber pressure rise, and increased engine noise, and can also result in an excessive increase in emission from the engine of unburned hydrocarbons.

While low fuel cetane number is believed to be a major contributing factor to the coking problem, it is not the only relevant factor. Thermal and oxidative stability (lacquering tendencies), fuel aromaticity, and such fuel characteristics as viscosity, surface tension and relative density have also been indicated to play a role in the coking problem.

An important contribution to the art would be a fuel composition which has enhanced resistance to coking tendencies when employed in the operation of indirect injection diesel engines.

THE INVENTION

In accordance with one of its embodiments, this invention provides distillate fuel for indirect injection compression ignition engines containing at least the combination of (a) organic nitrate ignition accelerator, (b) copolymer of an alpha-olefin having from 8 to 30 carbons and an N-substituted maleimide wherein the N-substituents are organic radicals having from 3 to 60 carbons and from 1 to 5 amine nitrogens, said copolymer having from 4 to 20 repeating olefin-maleimide units, and (c) hydrocarbyl amine having from 3 to 60 carbons and from 1 to 10 nitrogens, said combination being present in an amount sufficient to minimize coking, especially throttling nozzle coking, in the prechambers or swirl chambers of indirect injection compression ignition engines operated on such fuel.

This invention provides in another of its embodiments a method of inhibiting coking, especially throttling nozzle coking, in an indirect injection compression ignition engine, which comprises supplying said engine with a distillate fuel containing at least the combination of (a) organic nitrate ignition accelerator, (b) copolymer of an alpha-olefin having from 8 to 30 carbons and an N-substituted maleimide wherein the N-substituents are organic radicals having from 30 to 60 carbons and from 1 to 5 amine nitrogens, said copolymer having from 4 to 20 repeating olefin-maleimide units, and (c) hydrocarbyl amine having from 3 to 60 carbons and from 1 to 10 nitrogens, said combination being present in an amount sufficient to minimize such coking in the engine operated on such fuel.

A feature of this invention is that the combination of additives utilized in its practice is capable of exerting synergistic effects in suppressing coking tendencies of fuels used to operate indirect injection compression ignition engines. Such synergistic behavior was exhibited in a series of standard engine dynamometer tests conducted as described in Example I hereinafter.

A wide variety of organic nitrate ignition accelerators may be employed in the fuels of this invention. Preferred nitrate esters are the aliphatic or cycloaliphatic nitrates in which the aliphatic or cycloaliphatic group is saturated, contains up to about 12 carbons and, optionally, may be substituted with one or more oxygen atoms.

Typical organic nitrates that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used. A preferred ignition accelerator for use in the fuels of this invention is a mixture of octyl nitrates available as an article of commerce from Ethyl Corporation under the designation DII-3 ignition improver.

For a comprehensive description of component (b) of the fuels of this invention, i.e., one or more copolymers of an alpha-olefin having from 8 to 30 carbons and an N-substituted maleimide wherein the N-substituents are organic radicals having from 3 to 60 carbons and from 1 to 5 amine nitrogens, said copolymer(s) having from 4 to 20 repeating olefin-maleimide units, and methods by which such materials may be prepared, see U.S. Pat. Nos. 3,413,104 and 3,471,458, all disclosures of which are incorporated herein. A preferred imide derivative of this type is available as an article of commerce from Chevron Chemical Company under the designation OFA 425B. This product comprises a mixture of active ingredients and solvent. Thus when OFA 425B is used as component (b) in formulating the fuels of this invention, the product as received should be used at a concentration of at least about 35 PTB and preferably at least about 60 PTB to insure that the finished blend contains an adequate quantity of the foregoing copolymeric substituted imide.

While a variety of hydrocarbyl amines may be used as component (c) of the fuels of this invention, it is preferred that the fuel contain as component (c) at least 10 and preferably at least 20 pounds per thousand barrels (PTB) of primary aliphatic amine, the aliphatic group of which is tertiary, e.g., an amine of the formula:

$$R—NH_2$$

wherein R is one or a mixture of tertiary aliphatic groups containing 8 to 18 or more (preferably 12 to 16) carbon atoms. Most preferably these tertiary aliphatic groups are tertiary alkyl groups. It is also preferred that component (c) include in addition to the above-depicted amine one or more other hydrocarbyl amines differing therefrom.

U.S. Pat. No. 3,909,215, all disclosure of which is incorporated herein, gives a description of the various hydrocarbyl amines having from 3 to 60 carbons and from 1 to 10 nitrogens which may be employed for component (c) of the fuel blends of this invention. A few additional examples of desirable amines for use in the fuels of this invention include 2,6-ditert-butyl-α-dimethylamino-p-cresol, N-cyclohexyl-N,N-dimethylamine, and N-alkyl-N,N-dimethylamines in which the alkyl group is one or a combination of alkyl groups preferably having 8 to 18 or more carbon atoms.

The nitrate ignition accelerator—component (a)—should be present in an amount of at least 400 PTB and preferably at least about 500 PTB of the base fuel. Most preferably the concentration of the ignition accelerator is at least about 1000 PTB.

The amount of imine—component (b)—present in the fuels of this invention is preferably at least 40 PTB, although smaller amounts may be successfully employed.

The fuels of this invention should contain at least 10 and preferably at least 20 PTB of component (c), the hydrocarbyl amine.

On the basis of the experimental evidence available thus far, it is not believed that there is anything critical as regards the maximum amount of components (a), (b) and (c) used in the fuel. Thus, the maximum amount of these components will probably be governed in any given situation by matters of choice and economics.

Other additives may be utilized in the fuels of this invention, such as rust inhibitors, metal deactivators, cold flow improvers, inert solvents or diluents, antioxidants, and the like. The nature of such materials is well known to those skilled in the art, and numerous suitable materials have been described in the literature.

The practice and advantages of this invention will become still further apparent from the following illustrative Examples.

EXAMPLE I

In order to determine the effect of various fuel compositions on the coking tendency of diesel injectors in indirect injection compression ignition engines, use was made of a commercial diesel engine operated on a coking test cycle developed by Institute Francais Petrole and as practiced by Peugeot S. A. The amount of coking together with a quantitative indication of the adverse consequences of such coking was determined by means of (i) injector air flow performance, (ii) emission of unburned hydrocarbons, (iii) engine noise, and (iv) injector deposit ratings. The engine employed in the tests was a 1982 Peugeot 2.3 liter, 4-cylinder, turbocharged XD2S diesel engine connected to a Midwest dynamometer through an engine clutch. This engine is equipped with Bosch injectors positioned within prechambers, and is deemed representative of the indirect injection compression ignition engines widely used in automobiles and light-duty trucks.

The base fuel employed in these engine tests was a commercially-available diesel fuel having a nominal cetane rating of 42. FIA analysis indicated the fuel was composed by volume of 31.5% aromatics, 3.0% olefins and 65.5% saturates. Its distillation range (ASTM D-158) was as follows:

| Barometer | 29.46 inches of Hg |
|---|---|
| Initial | 406° F. |
| % Evaporated | at °F. |
| 5 | 439 |
| 10 | 450 |
| 15 | 456 |
| 20 | 463 |
| 30 | 480 |
| 40 | 499 |
| 50 | 521 |
| 60 | 545 |
| 70 | 572 |
| 80 | 603 |
| 85 | 621 |
| 90 | 643 |
| 95 | 678 |
| Final | 678° F. |
| Recovery | 97.5% |
| Residue | 2.5% |
| Loss | None |

Other inspection data on the base fuel were as follows:

| | |
|---|---|
| Kinematic Viscosity, (ASTM D-445) | 3.50 Centistokes, 40° C. |
| Pour Point (ASTM D-97) | −26° C. |
| Cloud Point (ASTM D-97) | 33° C. |
| Flash Point (ASTM D-93) | 91° C. |
| Steam Jet Gum | 2.4 mg/100 ml |
| Aniline Point (ASTM D-611) | 143.4° F. |
| Total Sulfur | 0.41 wt % |
| Ramsbottom Carbon, % (ASTM D-524) | 0.1460 on 10% Residuum |
| Gravity (ASTM D-287) | 31.8 °API |
| Specific Gravity @ 25° C. | 0.86 |
| Cetane rating | 41 |

Several test blends were prepared from this base fuel. In one case (Fuel A) mixed octyl nitrates (a commercial product available from Ethyl Corporation under the designation DII-3 Ignition Improver) was blended in the fuel to a concentration of 1012 pounds per thousand barrels (PTB) or 0.3% by volume.

Another fuel blend (Fuel B) contained a combination of (i) 41 PTB of OFA 425B, a product of Chevron Chemical Company, the active ingredient of which is an imide of an olefin-maleic anhydride copolymer and (ii) 14 PTB of a hydrocarbyl amine available commercially from Rohm and Haas Company under the designation Primene 81R. The OFA 425B dispersant is believed to contain as a principal active ingredient a copolymer of $C_{15-20}$ cracked wax alpha-olefin and N-substituted maleimide where the N-substituents are organic radicals derived by reacting the corresponding olefin-maleic anhydride copolymer with an amine exemplified by N-octadecenyl propylenediamine (See U.S. Pat. Nos. 3,413,104; 3,471,458; and 3,909,515). The manufacturer gives the following typical properties for its OFA 425 product:

| | |
|---|---|
| Chemical Analysis | |
| Nitrogen, wt % | 3.2 |
| Base No., mg KOH/g | 37 |
| Physical Analysis | |
| Gravity at 60° F. | |
| API° | 26.0 |
| Specific | 0.8984 |
| Lbs/gal (US) | 7.418 |
| Flash Point (COC), °F. | 110 |
| Pour Point, °F. | −5 |
| Viscosity at 100° F. | |
| SUS | 150.0 |
| Centistokes | 31.90 |
| Color, ASTM D-1500 | 6.0 |

The Primene 81R is believed to be a mixture of primary aliphatic amines in which the aliphatic groups are predominantly $C_{12}$ and $C_{14}$ tertiary alkyl groups.

Fuel C, the fuel blend of this invention, contained the combination of the additive ingredients of Fuel A and of Fuel B. The respective additives were used in the same concentrations as in Fuels A and B. Fuels B and C also contained small amounts of conventional rust inhibitors, metal deactivator and inert solvents.

Shell Rotella T, an SAE 30, SF/CD oil was used as the crankcase lubricant.

Before starting each test new Bosch DNOSD-1510 nozzles were installed using new copper gaskets and flame rings. The fuel line was flushed with the new test fuel composition to be tested and the fuel filter bowl and fuel return reservoir were emptied to avoid additive carry-over from test-to-test.

At the start of each test, the engine was operated at 1000 rpm, light load for 15 minutes. After this warm-up, the engine was subjected to the following automatic cycle:

| Event | RPM | Beam Load | Minutes | EGR |
|---|---|---|---|---|
| 1 | 750 | 0 | 4 | off |
| 2 | 2750 | 12.0 | 6 | on |
| 3 | 1500 | 6.2 | 6 | on |
| 4 | 4000 | 16.2 | 4 | off |

The above 20-minute cycle was repeated 60 times and the test was completed by running the engine at idle for another 30 minutes. The total elapsed time was thus 20.5 hours per test.

When passing from one event to the next event in the above cycle, some time of course was required to enable the engine to accelerate or decelerate from one speed to the next. Thus, more specifically, the above cycle was programmed as follows:

| Segment | Seconds | rpm | Beam Load |
|---|---|---|---|
| 1 | 2 | 750 | 0 |
| 2 | 200 | 750 | 0 |
| 3 | 3* | 2500 | 12 |
| 4 | 7* | 2750 | 12 |
| 5 | 350 | 2750 | 12 |
| 6 | 3* | 2275 | 6.2 |
| 7 | 7* | 1500 | 6.2 |
| 8 | 330 | 1500 | 6.2 |
| 9 | 3* | 3500 | 16.2 |
| 10 | 7* | 4000 | 16.2 |
| 11 | 230 | 4000 | 16.2 |
| 12 | 3* | 2000 | 0 |

-continued

| Segment | Seconds | rpm | Beam Load |
|---|---|---|---|
| 13 | 7* | 750 | 0 |
| 14 | 30 | 750 | 0 |

*Represents two mode periods for acceleration or deceleration to the next condition.

Hydrocarbon exhaust emissions were measured at the start of each test (after the first 20-minute cycle), at the 6-hour test interval and at the end of the test. These measurements were made at 750, 1000, and 1400 rpm idle. Noise level readings were made at a location three feet from the engine exhaust side. The measurements were made at the start and at the end of the test while operating at three idle speeds, viz., 750, 1000 and 1400 rpm.

After the test operation, the injectors were carefully removed from the engine so as not to disturb the deposits formed thereon. Measurements were made of air flow through each nozzle at different pintle lifts, and pintle deposits were rated using the CRC deposit rating system.

The most significant test results are given in Table I, in which air flow is expressed as cc/min and hydrocarbon emissions as ppm.

TABLE I

| Fuel | Air Flow @ 0.1 mm Lift | Pintle Obturator Deposits (10 = clean) | Noise, DB EOT* | Noise, DB Incr. | Hydrocarbon Emissions EOT* | Hydrocarbon Emissions Incr. |
|---|---|---|---|---|---|---|
| Base** | 32 | 7.7 | 83.4 | 2.1 | 395 | 185 |
| A | 25 | 7.1 | 83.8 | 2.8 | 275 | 224 |
| B | 13 | 7.5 | 85.2 | 4.7 | 200 | 74 |
| C | 51 | 9.0 | 81.7 | 1.3 | 163 | 19 |

*Value at end of test; the increase (Incr.) shown is in comparison to the value at start of test.
**Average of three tests.

The results presented in Table I show that there were less coking deposits (higher air flow rate and fewer deposits), less engine noise and less hydrocarbon emissions with Fuel C, the fuel of this invention, as compared to the Base Fuel, Fuel A and Fuel B.

EXAMPLE II

In this instance a pair of tests was conducted according to the procedure of Example I using a high quality diesel fuel of higher nominal cetane value (47.5). The fuel specifications as furnished by the manufacturer were as follows:

| | |
|---|---|
| Distillation Range | |
| IBP, °F. | 386 |
| 10% Point, °F. | 430 |
| 50% Point, °F. | 506 |
| 90% Point, °F. | 576 |
| End Point, °F. | 610 |
| Aromatics (FIA), vol. % | 29.1 |
| Kinematic Viscosity, (ASTM D-445) | 2.5 Centistokes |
| Cloud Point (ASTM D-2500) | −2° F. |
| Flash Point (ASTM D-93) | 157° F. |
| Total Sulfur | 0.22 wt % |
| Gravity (ASTM D-287) | 35.8 °API |
| Particulate Matter | 2.39 |

One test was conducted using the base fuel as received. The fuel in the other test (Fuel D) contained 506 PTB (0.15% by volume) of DII-3 Ignition Improver, 83

PTB of OFA 425B Dispersant, and 27 PTB of Primene 81R Amine, and thus constituted a fuel of this invention.

Table II summarizes the results of these tests.

TABLE II

| Fuel | Air Flow @ 0.1 mm Lift | Pintle Obturator Deposits (10 = clean) | Noise, DB EOT* | Noise, DB Incr. | Hydrocarbon Emissions EOT* | Hydrocarbon Emissions Incr. |
|---|---|---|---|---|---|---|
| Base | 47 | 4.8 | 80.7 | −0.3 | 72 | 19 |
| D | 75 | 7.5 | 81.4 | 0.4 | 66 | 13 |

*Value at end of test; the increase (Incr.) shown is in comparison to the value at start of test.

The results in Table II indicate that even with a base fuel of high quality and relatively low coking tendencies, some improvements can be achieved by means of this invention.

I claim:

1. Distillate fuel for indirect injection compression ignition engines containing at least the combination of (a) organic nitrate ignition accelerator, (b) copolymer of an alpha-olefin having from 8 to 30 carbons and an N-substituted maleimide wherein the N-substituents are organic radicals having from 3 to 60 carbons and from 1 to 5 amine nitrogens, said copolymer having from 4 to 20 repeating olefin-maleimide units, and (c) hydrocarbyl amine having from 3 to 60 carbons and from 1 to 10 nitrogens, said combination being present in an amount sufficient to minimize coking on the nozzles of indirect injection compression ignition engines operated on such fuel.

2. The composition of claim 1 wherein said ignition accelerator is present at a concentration equivalent to at least about 400 pounds per thousand barrels of said fuel.

3. The composition of claim 1 wherein said hydrocarbyl amine is present at a concentration equivalent to at least about 20 pounds per thousand barrels of said fuel.

4. The composition of claim 2 wherein said hydrocarbyl amine is present at a concentration equivalent to at least about 20 pounds per thousand barrels of said fuel.

5. The composition of claim 1 wherein said ignition accelerator is present at a concentration equivalent to at least about 500 pounds per thousand barrels of said fuel.

6. The composition of claim 5 wherein said ignition accelerator is a mixture of octyl nitrates.

7. The composition of claim 5 wherein said hydrocarbyl amine is comprised of alkyl amine of the formula:

$$R—NH_2$$

wherein R is one or a mixture of tertiary alkyl groups containing 8 to 18 or more carbon atoms, said alkyl amine being present at a concentration equivalent to at least about 20 pounds per thousand barrels of said fuel.

8. The composition of claim 7 wherein R is one or a mixture of tertiary alkyl groups containing 12 to 16 carbon atoms.

9. The composition of claim 1 wherein said ignition accelerator is present at a concentration equivalent to at least about 1000 pounds per thousand barrels of said fuel.

10. The composition of claim 9 wherein said ignition accelerator is a mixture of octyl nitrates.

11. A method of inhibiting coking on the injector nozzles of an indirect injection compression ignition engine, which method comprises supplying said engine with a distillate fuel containing at least the combination of (a) organic nitrate ignition accelerator, (b) copolymer of an alpha-olefin having from 8 to 30 carbons and an N-substituted maleimide wherein the N-substituents are organic radicals having from 3 to 60 carbons and from 1 to 5 amine nitrogens, said copolymer having from 4 to 20 repeating olefin-maleimide units, and (c) hydrocarbyl amine having from 3 to 60 carbons and from 1 to 10 nitrogens, said combination being present in an amount sufficient to minimize such coking in the engine operated on such fuel.

12. The method of claim 11 wherein said ignition accelerator is present at a concentration equivalent to at least about 400 pounds per thousand barrels of said fuel.

13. The method of claim 11 wherein said hydrocarbyl amine is present at a concentration equivalent to at least about 20 pounds per thousand barrels of said fuel.

14. The method of claim 12 wherein said hydrocarbyl amine is present at a concentration equivalent to at least about 20 pounds per thousand barrels of said fuel.

15. The method of claim 11 wherein said ignition accelerator is present at a concentration equivalent to at least about 500 pounds per thousand barrels of said fuel.

16. The method of claim 15 wherein said ignition accelerator is a mixture of octyl nitrates.

17. The method of claim 15 wherein said hydrocarbyl amine is comprised of alkyl amine of the formula:

$$R—NH_2$$

wherein R is one or a mixture of tertiary alkyl groups containing 8 to 18 or more carbon atoms, said alkyl amine being present at a concentration equivalent to at least about 20 pounds per thousand barrels of said fuel.

18. The method of claim 17 wherein R is one or a mixture of tertiary alkyl groups containing 12 to 16 carbon atoms.

19. The method of claim 11 wherein said ignition accelerator is present at a concentration equivalent to at least about 1000 pounds per thousand barrels of said fuel.

20. The method of claim 19 wherein said ignition accelerator is a mixture of octyl nitrates.

* * * * *

UNITED STATES PATENT AND TRADEMARK OFFICE

CERTIFICATE OF CORRECTION

PATENT NO. : 4,482,353

DATED : November 13, 1984

INVENTOR(S) : J. Vincent Hanlon

It is certified that error appears in the above-identified patent and that said Letters Patent is hereby corrected as shown below:

Column 2, line 11, reads "30 to 60 carbons" and should read -- 3 to 60 carbons --.

Column 5, line 4, reads "Nitrogen, wt % 3.2" and should read -- Nitrogen, wt % 2.2 --.

Signed and Sealed this

*Fourteenth* Day of *May 1985*

[SEAL]

*Attest:*

DONALD J. QUIGG

*Attesting Officer* *Acting Commissioner of Patents and Trademarks*